United States Patent [19]

Jackson

[11] 4,164,269

[45] Aug. 14, 1979

[54] SAFETY BRACKET FOR SECURING LADDER IN PLACE

[75] Inventor: Charles E. Jackson, Newton, N.C.

[73] Assignee: E. L. Hilts & Company, Charlotte, N.C.

[21] Appl. No.: 953,962

[22] Filed: Oct. 23, 1978

[51] Int. Cl.[2] ..... E06C 7/48

[52] U.S. Cl. ..... 182/229; 182/82; 182/107; 182/206; 248/210

[58] Field of Search ..... 182/206, 107, 108, 82, 182/229; 248/210

[56] References Cited

U.S. PATENT DOCUMENTS

| | | | |
|---|---|---|---|
| 396,552 | 1/1889 | Elsbury | 182/206 |
| 437,934 | 10/1890 | O'Brien | 182/229 |
| 1,937,608 | 12/1933 | Tobin | 182/82 |
| 3,472,338 | 10/1969 | Weidman | 182/82 |

FOREIGN PATENT DOCUMENTS

| | | | |
|---|---|---|---|
| 276065 | 9/1951 | Switzerland | 182/229 |
| 320684 | 5/1957 | Switzerland | 182/82 |

*Primary Examiner*—Reinaldo P. Machado
*Attorney, Agent, or Firm*—Richards, Shefte & Pinckney

[57] ABSTRACT

A safety bracket for securing a ladder in place against a building structure, the bracket having two extending arm members interconnected in crossing relation intermediate the respective ends thereof with each arm member being slidable with respect to the other. Each arm member includes an intermediate portion and two end portions pivotally joined to the intermediate portion, the two end portions of each arm member including, respectively, a hook shaped portion which may be hooked around an upright member of a ladder and an eyelet for receiving therethrough a projecting member secured to the building structure.

7 Claims, 4 Drawing Figures

SAFETY BRACKET FOR SECURING LADDER IN PLACE

BACKGROUND OF THE INVENTION

The present invention relates to a device for holding a ladder securely in place against a building structure to facilitate the safe use thereof. After the initial location and placement of a ladder against a house or other building structure, there is always the danger that the upper end thereof may slide to one side or the other during its use. This risk is substantially increased when a workman is standing on one of the upper rungs of the ladder because the weight of the workman is concentrated at the top of the ladder and is substantially displaced from the bottom end of the ladder providing the sole support therefor. It is therefore not surprising that statistics published by the National Roofing Contractors Association reveal that injuries resulting from falls represent one of the two most frequent time-loss accidents which plague roofing workmen, most such falls resulting from inadequate or non-existent tie-off of ladders used by workmen to gain access to the roof of a building structure.

A number of devices designed to engage a ladder and hold it securely in place against a building during its use have heretofore been proposed. Such devices have generally utilized a variety of means for engaging the building to prevent inadvertent or accidental movement of the ladder from its initial resting place against the building, some of these prior art devices including pointed elements disposed to slightly penetrate the roof of the building while other devices provide members which merely frictionally engage the roof of the building. Typical of these types of ladder supports are those shown in J. J. Gilmour, et al., U.S. Pat. No. 2,815,160, W. Enssle, U.S. Pat. No. 1,522,292, and E. W. Wendel, U.S. Pat. No. 1,467,597. While each of these devices provides some degree of stability to the ladder to which they are attached, such devices may nevertheless be disengaged from the building with relatively little force, thereby providing only minimal protection against accidental sliding of the ladder with respect to the structure against which it is supported. Still other devices provide means for engaging the ladder and holding it securely to the roof guttering normally provided on houses and other small building structures, an example of this type of device being found in Jarboe, U.S. Pat. No. 3,853,202. Finally, as shown in Phelan, U.S. Pat. No. 3,903,991, other devices utilize relatively complex locking assemblies which must be bolted both to the ladder itself and to the building structure against which it is to rest.

In contrast, the present invention provides a safety bracket for securing a ladder in place against a building structure which may be relatively quickly and easily attached in place without requiring complicated locking assemblies or engagement of guttering and which provides significantly greater stability against accidental disengagement of the ladder from the building than conventional devices which utilize frictional members or pointed elements to engage the roof of the building.

SUMMARY OF THE INVENTION

The present invention provides a safety bracket for securing a ladder in place against a building structure, the safety bracket including two extending arm members and interconnection means disposed intermediate the respective ends of the arm members to connect the arm members in crossing relation so that each arm member is slidable with respect to the other. Each of the arm members have first attachment means at one end thereof for attaching the arm members to the ladder, and each arm member has second attachment means at the other end thereof for receiving a projecting member secured to the building structure.

According to the preferred embodiment of the present invention, the first attachment means comprises a hook shaped portion formed at one end of each arm member which may be hooked around an upright member of the ladder to attach such ends to the ladder, and the second attachment means comprises an eyelet formed at the other end of each arm member for receiving the projecting member therethrough to attach such other ends to the building structure. The interconnecting means includes a bridge portion connected at each end thereof to one of the arm members intermediate the respective ends thereof and extending in spaced parallel relation thereto. In this manner, a slot is defined through which the other arm member extends in sliding relation to such one arm member.

It is additionally preferred that each arm member include an intermediate portion and two end portions joined to the intermediate portion by pivot connection means, the two end portions including the first and second attachment means, respectively. The pivot connection means includes interengaging eyelets formed at the adjacent ends of the intermediate portion and the two end portions, the interengaging eyelets having dimensions larger than the slot to prevent separation of the arm members.

DESCRIPTION OF THE PREFERRED EMBODIMENT

Figure 1:
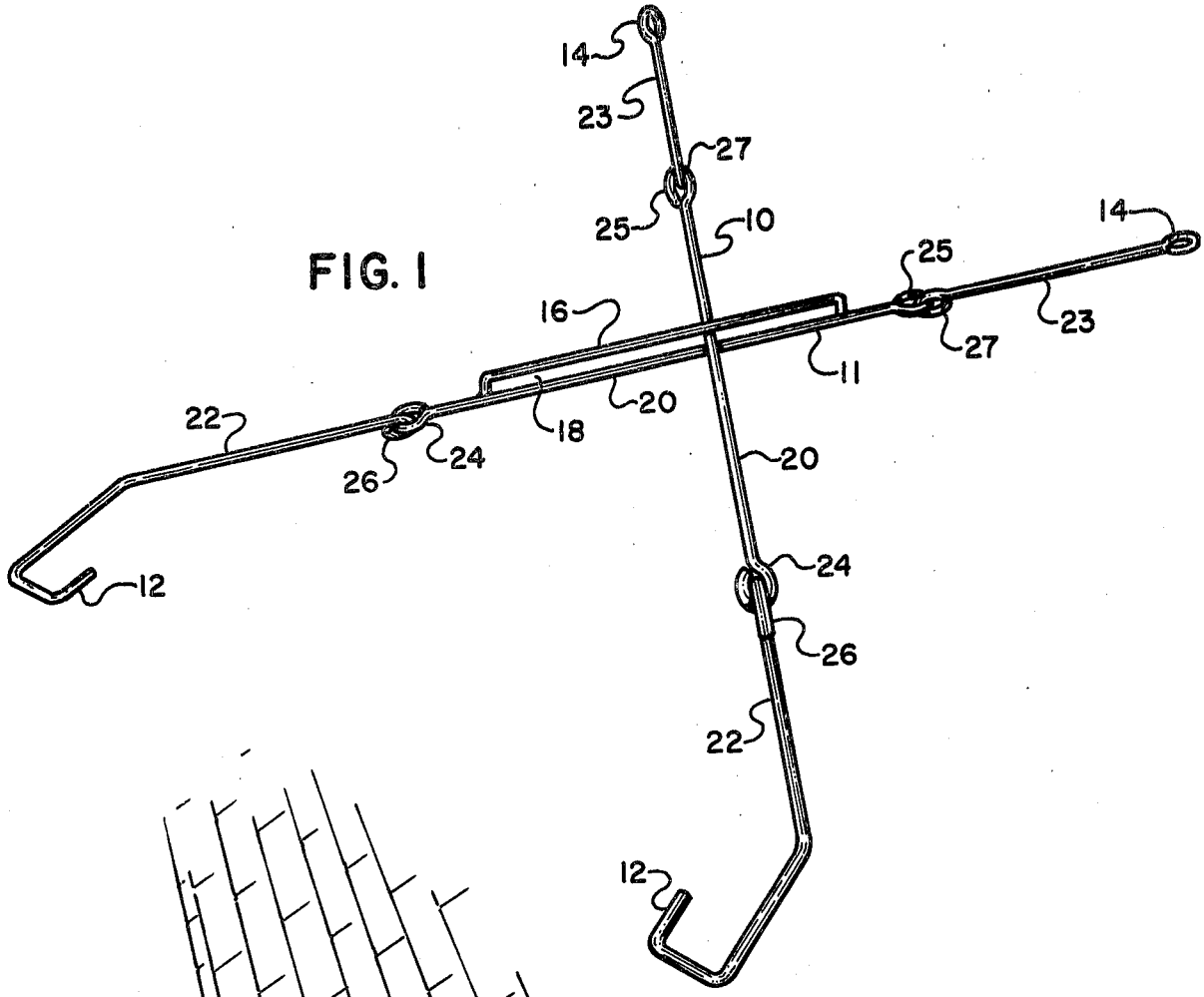
FIG. 1 is a perspective view of a safety bracket according to the preferred embodiment of the present invention.
Figure 2:
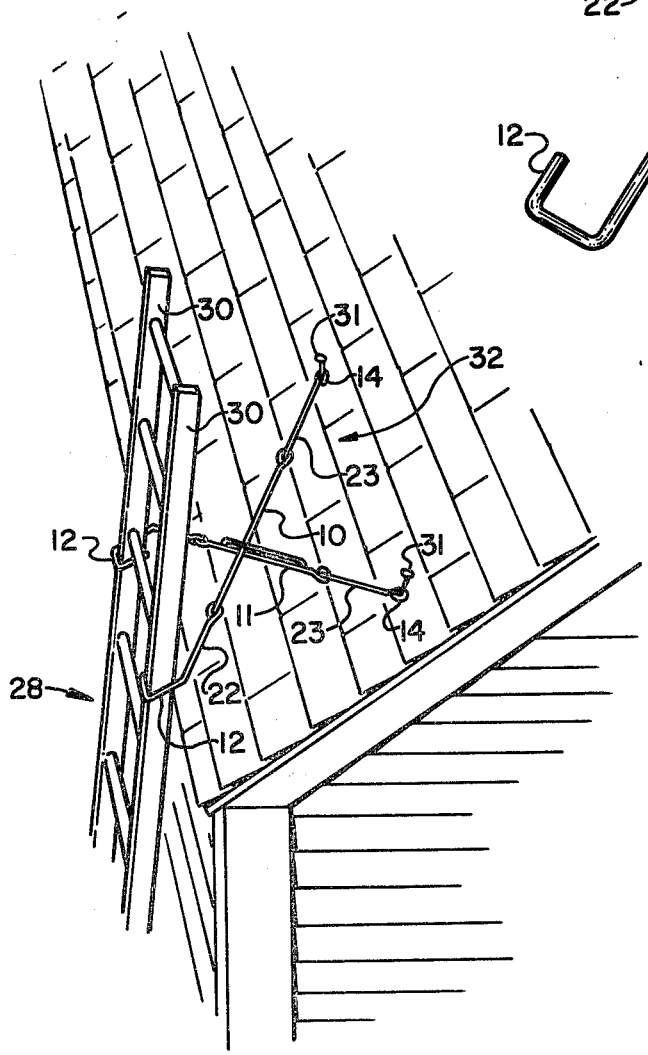
FIG. 2 is a perspective view illustrating the safety bracket of FIG. 1 in use to secure a ladder in place against a building structure having a slanted roof.
Figure 3:
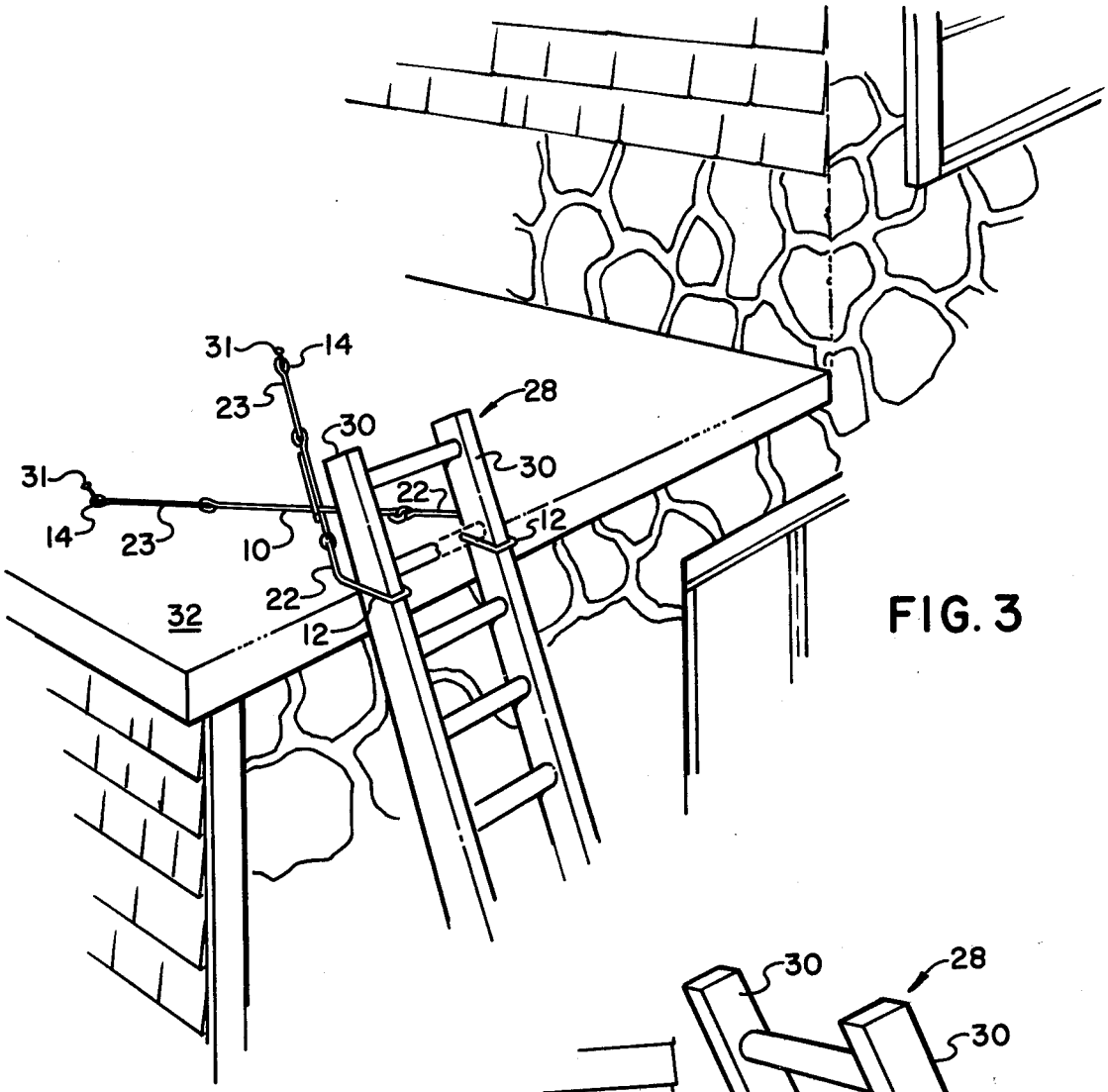
FIG. 3 is a perspective view of the safety bracket of FIG. 1, taken from a perspective different from that of FIG. 2, illustrating the bracket in use to secure a ladder in place against a building structure having a flat roof.
Figure 4:
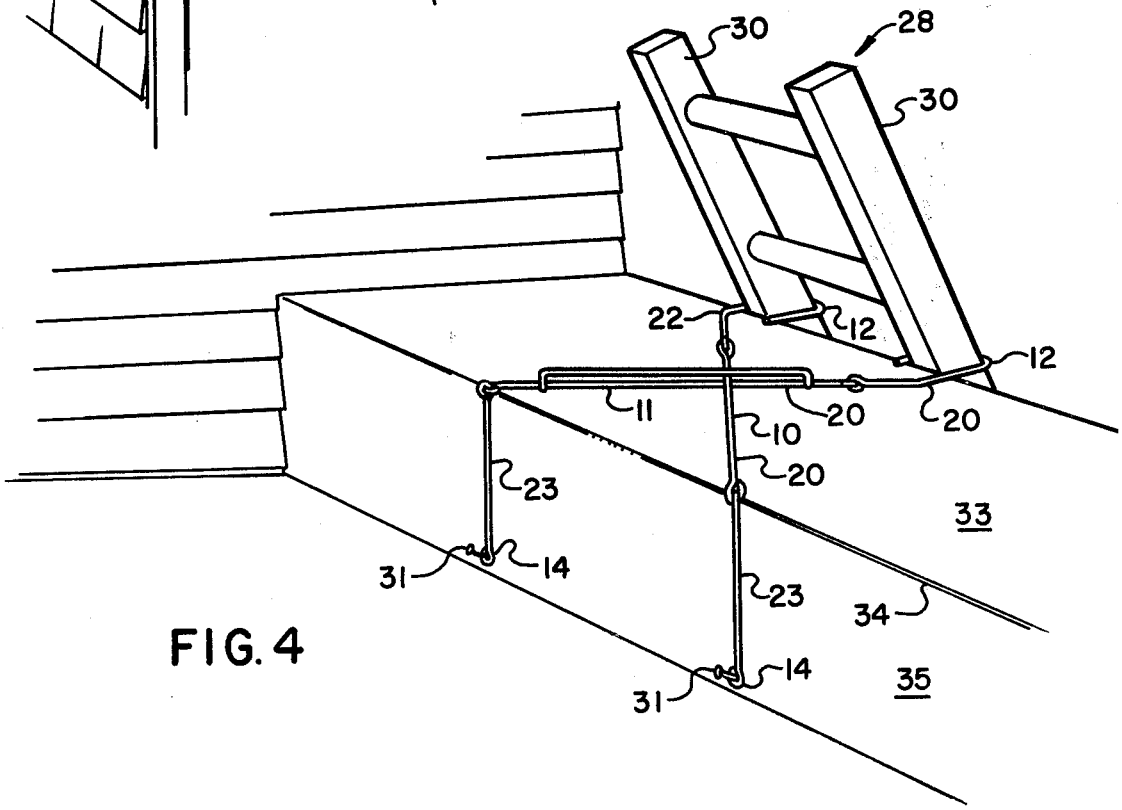
FIG. 4 is a perspective view similar to FIG. 2, illustrating the safety bracket in use to secure a ladder in place against a building structure having a flat roof with a parapet.

Referring now in detail to the accompanying drawings, FIG. 1 illustrates the preferred embodiment of the safety bracket of the present invention, and FIGS. 2–4 illustrate such safety bracket as it would typically be used in securing a ladder to buildings having a variety of roof structures, it being understood that the safety bracket of the present invention is not limited to the representative application illustrated in the drawings.

Referring now to FIG. 1, the safety bracket of the present invention comprises two extending arm members 10, 11, each arm member 10, 11, having a hook shaped portion 12 formed at one end thereof which may be readily hooked around an upright member or rail of a ladder to attach the extending arm members 10, 11, to the ladder, and each arm member 10, 11, also having an eyelet 14 formed at the other end thereof for receiving therethrough a nail or spike driven into the roof of a building or any similar projecting member which is secured to the roof of the building structure against which the ladder is to be placed, to thereby attach the extending arm members 10, 11, to the building structure. A bridge portion 16 is connected at each end thereof to arm member 11 intermediate the respective ends thereof in spaced parallel relation thereto to define a slot 18 through which arm member 10 extends. In this manner, the extending arm members 10, 11, are interconnected in crossing relation with each arm member 10, 11 being slidable with respect to the other. By virtue of the crossing relationship between the respective arm members 10, 11, the respective arm members 10, 11 of the safety bracket, when in use, exert opposing forces against the ladder to which the bracket is attached, thereby opposing the forces which can cause an unsecured ladder to slide with respect to the structure against which it is supported and securing the ladder in a more static state than would be the case if a bracket comprising two non-crossing arm members were used. The slot 18 allows slidable adjustment of the arm members 10, 11, which assists the user in manipulating the bracket to adapt it to the installation requirements of a variety of different roof shapes and slopes, thereby enabling the user to maximize the aforesaid static effect obtained from the crossing relationship of the arm members.

It is additionally preferred that each of the two extending arm members 10, 11, include an intermediate portion 20 and two end portions 22, 23, connected, as hereinafter described, to opposite ends of the intermediate portion 20, each end portion 22 having at the outer end thereof the hook shaped portion 12 described above, and each end portion 23 having at its outer end the above-described eyelet 14. Each intermediate portion 20 is provided with two eyelets 24, 25, formed at opposite ends thereof, the eyelets 24 being interconnected with corresponding eyelets 26 at the inner ends of end portions 22, respectively and the eyelets 25 being interconnected with corresponding eyelet 27 at the inner ends of end portions 23, respectively, whereby each intermediate portion 20 is pivotally connected individually with each of its respective end portions 22, 23. The intermediate portion 20 of arm member 11 includes the above-described bridge portion 16 and slot 18, with the arm member 10 extending through slot 18 and the intermediate portion 20 thereof being slidable therewithin. The pivotal units formed by interengaging eyelets 24, 26, and interengaging eyelets 25, 27, have height and width dimensions larger than the width of the slot 18 to prevent separation of the interconnected arm members 10, 11. In this manner, not only is the safety bracket of the present invention slidably adjustable by virtue of the interconnection of arm members 10, 11, at slot 18, the arm members 10, 11, are also each individually pivotally adjustable by virtue of the pivotal connection of each intermediate portion 20 with each of its respective end portions 22 and 23, thereby allowing the pivotal manipulation of the safety bracket to adjust it to conform to almost any conventional roof design or configuration.

It can therefore be seen, as illustrated in FIGS. 2 and 3, that the safety bracket of the present invention may be installed to secure a ladder, indicated generally at 28, placed against the edge of the roof of a building structure by initially engaging the hook shaped portions 12 about the upright members or rails 30 of the ladder 28 at a location adjacent the roof edge, extending the arm members 10, 11, outwardly therefrom over the roof (indicated generally at 32) in opposite directions until taut, and securing the end portions 23 to the roof 32 by driving a rail or spike 31 through each eyelet 14. In this manner, a ladder placed against a building having a slanted roof (FIG. 2) or a flat roof (FIG. 3) may be quickly and easily secured against sliding or falling. Additionally, the safety bracket of the present invention may be easily installed in a similar manner on building structures which do not have a flat surface adjacent the roof edge against which the ladder is placed and over which the safety bracket could be planarly extended. An example of such an installation is illustrated in FIG. 4 wherein the safety bracket of the present invention has been utilized to secure a ladder against a building structure having a flat roof with a parapet. By virtue of the pivotable end portions 22, 23 and the relatively slidable intermediate portions 20, optimum stability of the ladder is achieved by initially attaching the hook shaped portions 12 to the rails 30 of the ladder 28 and extending the arm members 10, 11, outwardly in opposite directions while slidably adjusting the intermediate portions 20 to locate the pivotal connection between the intermediate portions 20 and their respective end portions 23 at the rear edge 34 of the parapet wall 33. The end portions 23 may then be pivoted to extend downwardly along the vertical inner surface 35 of the wall 33 and secured in place by driving a rail or spike 31 through each eyelet 14. The safety bracket of the present invention may be similarly adjusted to conform to other irregular roof or wall designs by adjusting the bracket to locate the pivotal connections between the intermediate portions 20 and the end portions 22, 23, at points or lines of change in the roof configuration.

Although the present invention has been described in relation to the preferred embodiments, it is to be understood that modifications and variations may be resorted to without departing from the substance or scope of the present invention, as those skilled in the art will readily understand. Such modifications and variations are within the scope of the present invention, which is intended to be limited only by the appended claims and equivalents thereof.

I claim:

1. A safety bracket for securing a ladder in place against a building structure, said safety bracket comprising two extending arm members, and interconnection means disposed intermediate the respective ends of said arm members to connect such arm members in crossing relation with each said arm member being slidable with respect to the other, each of said arm members having first attachment means at one end thereof for attaching said arm member to said ladder, and each said arm member having second attachment means at the other end thereof for receiving a projecting member secured to said building structure.

2. A safety bracket for securing a ladder in place against a building structure according to claim 1, said first attachment means comprising a hook shaped portion formed at each said one end which portion may be hooked around an upright member of said ladder to attach said extending arm members to said ladder.

3. A safety bracket for securing a ladder in place against a building structure according to claim 1, said second attachment means comprising an eyelet formed at each said other end for receiving said projecting member therethrough to attach said extending arm members to said building structure.

4. A safety bracket for securing a ladder in place against a building structure according to claim 1 and characterized further in that said interconnections means includes a bridge portion connected at each end thereof to one said arm member intermediate the respective ends thereof and extending in spaced parallel relation thereto to define a slot through which the other arm member extends in sliding relation to said one arm member.

5. A safety bracket for securing a ladder in place against a building structure according to claim 1 and characterized further in that each said arm member includes an intermediate portion and two end portions joined to said intermediate portion by pivot connection means, said two end portions including said first and second attachment means, respectively.

6. A safety bracket for securing a ladder in place against a building structure according to claim 1 and characterized further in that said pivot connection means includes interengaging eyelets formed at the adjacent ends of said intermediate portion and each of said two end portions of each said arm member.

7. A safety bracket for securing a ladder in place against a building structure according to claim 6 and characterized further in that said interconnection means between said arm members includes a bridge portion connected at each end thereof to said intermediate portion of one said arm member and extending in spaced parallel relation thereto to define a slot through which the other arm member extends in sliding relation to said one arm member, said interengaging eyelets having dimensions. larger than said slot to prevent separation of said arm member.

* * * * *